US010995542B2

(12) United States Patent
Tenzon

(10) Patent No.: US 10,995,542 B2
(45) Date of Patent: May 4, 2021

(54) OUTDOOR WINDOW

(71) Applicant: UNIFORM S.p.A., Minerbe (IT)

(72) Inventor: Franco Tenzon, Minerbe (IT)

(73) Assignee: UNIFORM S.p.A., Minerbe (IT)

( * ) Notice: Subject to any disclaimer, the term of this patent is extended or adjusted under 35 U.S.C. 154(b) by 192 days.

(21) Appl. No.: 16/249,920

(22) Filed: Jan. 17, 2019

(65) Prior Publication Data

US 2019/0226269 A1 Jul. 25, 2019

(30) Foreign Application Priority Data

Jan. 19, 2018 (IT) ..... 102018000001548

(51) Int. Cl.

| | |
|---|---|
| ***E06B 3/00*** | (2006.01) |
| ***E06B 3/36*** | (2006.01) |
| ***E05D 11/00*** | (2006.01) |
| ***E06B 3/02*** | (2006.01) |
| ***E05D 5/04*** | (2006.01) |
| ***E05D 5/02*** | (2006.01) |
| ***E05D 5/06*** | (2006.01) |

(Continued)

(52) U.S. Cl.

CPC ..... *E06B 3/36* (2013.01); *E05D 3/02* (2013.01); *E05D 5/02* (2013.01); *E05D 5/0238* (2013.01); *E05D 5/04* (2013.01); *E05D 5/06* (2013.01); *E05D 11/0054* (2013.01); *E06B 3/025* (2013.01); *E06B 3/6617* (2013.01); *E05Y 2900/132* (2013.01); *E05Y 2900/148* (2013.01); *E06B 3/302* (2013.01); *E06B 3/325* (2013.01)

(58) Field of Classification Search

CPC ..... E06B 3/36; E06B 3/6617; E06B 3/325; E06B 3/302; E05D 11/0054; E05D 5/04; E05D 5/0238; E05D 5/06; E05D 5/02; E05Y 2900/132; E05Y 2900/148

See application file for complete search history.

(56) References Cited

U.S. PATENT DOCUMENTS 6,530,179 B1 * 3/2003 Fisher ..... E05D 5/10 16/254
2008/0060274 A1 * 3/2008 Vooght ..... E05D 15/264 49/394

(Continued)

FOREIGN PATENT DOCUMENTS

CA 3014796 A1 * 3/2019 ..... E06B 3/36
CH 171639 9/1934

(Continued)

*Primary Examiner* — Jerry E Redman
(74) *Attorney, Agent, or Firm* — Mark M. Friedman

(57) ABSTRACT

An outdoor window including a movable sash which is connected to a fixed frame by means of a hinge system, and is provided with a supporting frame comprising a supporting section bar connected with the hinge system. The pivoting system has a bracket fixed to the fixed frame and provided with a projecting portion, that is placed alongside the outer lateral face of the upright of the movable sash when the latter is closed. The pivoting system further comprises a hinge which is provided with a first wing fixed to the supporting section bar of the movable sash, and with a second wing fixed to the projecting portion of the bracket. The supporting frame of the movable sash comprises a protective section bar which covers the hinge and the supporting section bar of the movable sash when the latter is closed.

15 Claims, 12 Drawing Sheets

(51) Int. Cl.

| | |
|---|---|
| ***E05D 3/02*** | (2006.01) |
| ***E06B 3/66*** | (2006.01) |
| *E06B 3/30* | (2006.01) |
| *E06B 3/32* | (2006.01) |

(56) References Cited

U.S. PATENT DOCUMENTS

2011/0088217 A1* 4/2011 Bjorn ..... E05D 11/0018 16/235
2011/0126465 A1* 6/2011 Bai ..... E05D 15/52 49/260
2014/0087098 A1* 3/2014 Goodwin ..... E06B 3/6617 428/34
2016/0040463 A1* 2/2016 Gramstad ..... E05D 5/128 16/382
2016/0326787 A1* 11/2016 Criddle ..... E05D 5/0215
2019/0316404 A1* 10/2019 Rotondi ..... E05D 15/58
2019/0390507 A1* 12/2019 Bernhagen ..... E06B 3/66309
2020/0018105 A1* 1/2020 McDuff ..... E05D 15/22
2020/0109595 A1* 4/2020 Woodward ..... E06B 3/222
2020/0263463 A1* 8/2020 Woodward ..... E05C 3/165
2020/0263490 A1* 8/2020 Woodward ..... E06B 7/28

FOREIGN PATENT DOCUMENTS

| | | |
|---|---|---|
| CH | 550930 | 6/1974 |
| DE | 4007365 | 9/1991 |
| EP | 1134348 | 9/2001 |
| EP | 1705324 | 9/2006 |
| EP | 2811099 | 2/2014 |
| JP | S63162080 | 10/1988 |
| JP | 2002276251 | 9/2002 |
| JP | 5638713 | 12/2014 |
| WO | 2017064346 | 4/2017 |

* cited by examiner

OUTDOOR WINDOW

TECHNICAL FIELD

The present invention relates to an outdoor window, such as in particular a window or a French window, for closing a wall opening.

The outdoor window in question relates generally to the industrial sector of outdoor windows production, in particular for glass façades, that is those provided with a series of glass windows with opening or fixed shutters. More specifically, the outdoor window in question is of the type provided with thermal insulation and obtained by means of a composition of different materials such as wood, glass fibre, and aluminium.

The outdoor window according to the present invention is thereby advantageously usable for closing an opening arranged in a supporting structure of a building and, as above-mentioned, relates to the industrial sector of outdoor windows production.

STATE OF THE ART

Outdoor windows have been known since a long time, in particular advantageously usable for closing openings arranged on supporting structures of buildings, for example consisting of a window or a French window, provided with a fixed frame and a movable sash mechanically connected to the fixed frame through pivoting means.

More specifically, the fixed frame is formed by two first vertical uprights and two first horizontal crosspieces rigidly fixed to the vertical uprights at the edges to form a substantially quadrangular frame. The fixed frame is intended to be fixed to the supporting structure, either a metal structure or a wall, and is more specifically intended to be fixed to the inner faces of the walls delimiting the opening to which the outdoor window is associated.

The outdoor window generally further comprises a movable sash, provided with a supporting frame around which a glass panel is perimetrically fixed, for closing the opening.

The supporting frame comprises in turn two second vertical uprights and two second horizontal crosspieces firmly connected to the two second vertical uprights to form four vertices of the movable sash.

The movable sash is hinged at one of its second vertical uprights to one of the first vertical uprights of the fixed frame and it is movable between a closed position, wherein the movable sash lies in abutment against the fixed frame, and an open position, wherein the movable sash is positioned angularly to the fixed frame, at least partially freeing the defined opening from its supporting frame.

The pivoting means generally comprise a hinge known as "knob hinge" in the specific technical jargon, that is provided with two wings connected to each other by a pivot and respectively fixed to the fixed frame and to the movable sash.

More specifically, a first wing is fixed to a first cylindrical body inside which a pivot is fixed and accommodated so that it projects for at least one section of the cylindrical body, and a second wing is fixed to a second cylindrical body that rotatably accommodates the projecting portion of the pivot.

The outdoor windows of the known type briefly described herein have been found to have some practical inconveniences.

The main drawback lies in the fact that the outdoor windows that currently use pivoting means with knob hinges associated with the uprights of the frame and of the movable sashes are visible, thereby not always positively affecting the overall aesthetics of the window.

In order to overcome the drawbacks of the outdoor windows of the known type described above, in recent years outdoor windows have been developed that are provided with concealed pivoting means, that is with hinges that even if they are mounted on the uprights of the frame and of the sash, are capable of going back inside the fixed frame and/or the movable sash when the latter is in closed position.

Such concealed pivoting means are rather complex to produce and comprise a plurality of mutually flanked arms, provided with multiple hinging points, and are suitable to be accommodated in containment tanks that have to be obtained in the profiles of the frame and sash uprights.

Moreover, there are known outdoor windows comprising pivoting means provided with hinges that are invisible from the outside, which are mounted at the upper and lower angles of the frame and sash uprights being fixable with some supporting bodies to the respective crosspieces of the frame.

An example of outdoor window provided with externally invisible hinges of the type described above is mentioned in the patent WO 2017/064346, wherein the hinges are fixed at the first and second horizontal crosspieces.

Also the latter outdoor window of the known type so far briefly described has been found to have some practical inconveniences.

The main drawback lies in the fact that pivoting means provided with invisible hinges of the known type described above are complicated to install, costly to produce and require large sizes that are not easily compatible with the production of very thin windows, as is frequently demanded due to commercial architectural requirements.

PRESENTATION OF THE INVENTION

In this context, the present invention overcomes the inconveniences shown by the known solutions by providing an outdoor window that allows to hinge a sash to its frame at the respective uprights without visible pivoting systems in the closed position.

A further purpose of the present invention is to provide an outdoor window, provided with an extremely contained cross-section.

A further purpose of the present invention is to provide an outdoor window provided with extremely simple and low-cost pivoting systems.

A further purpose of the present invention is to provide an outdoor window that enables an operator to carry out its maintenance rapidly, easily and in a totally safe manner.

BRIEF DESCRIPTION OF THE DRAWINGS

The technical features of the invention, in accordance with the above purposes, will be apparent from the appended claims and the advantages will become clear from the detailed description that follows, with reference to the accompanying drawings, provided purely by way of a non-limiting example of embodiments in which:

DETAILED DESCRIPTION OF A PREFERRED EMBODIMENT OF THE INVENTION

Figure 1:
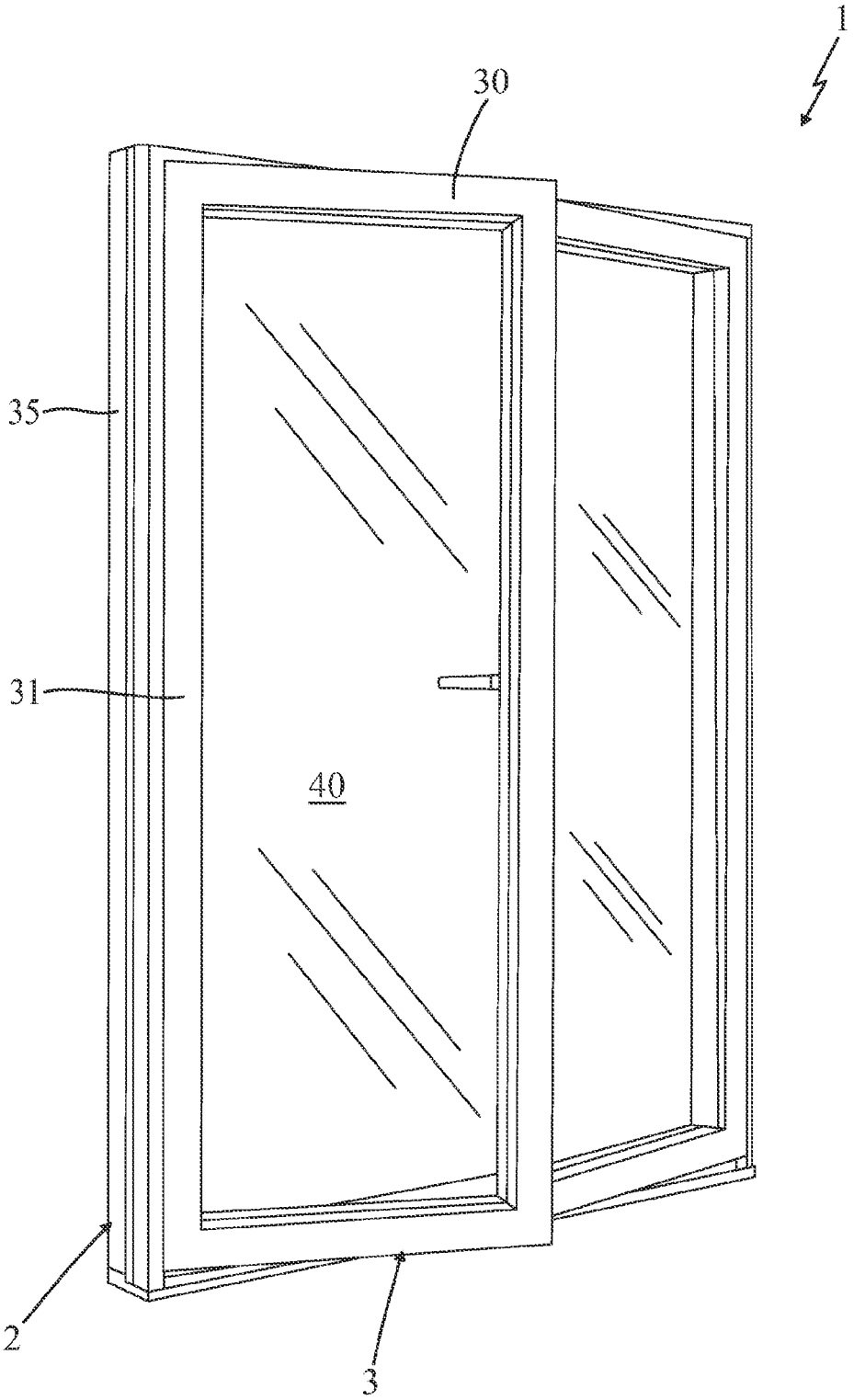
FIG. 1 is a perspective view of an outdoor window according to the present invention.
Figure 2:
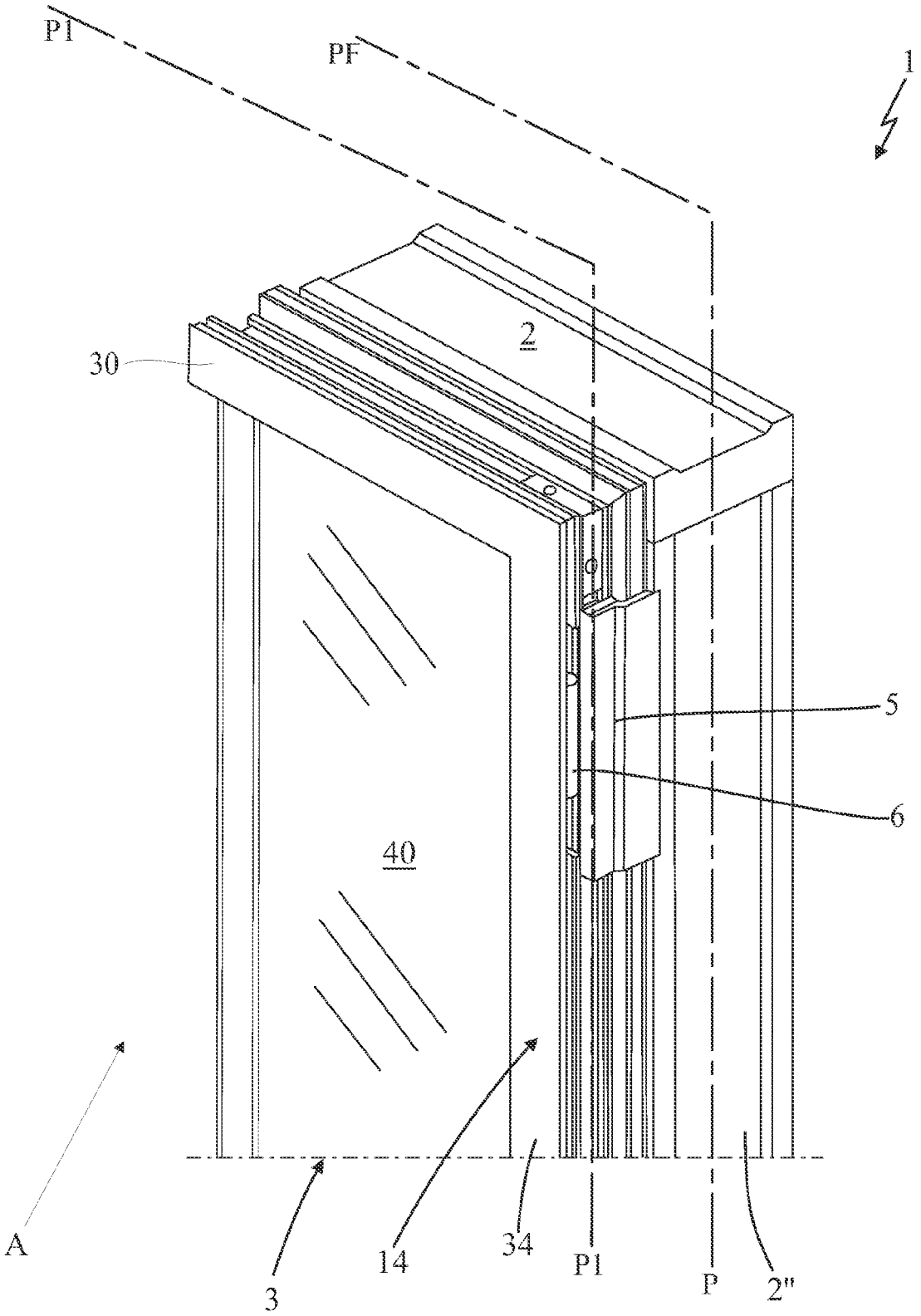
FIG. 2 is a perspective view of an angular portion of the outdoor window according to the present invention, with the sash in a closed position.
Figure 3:
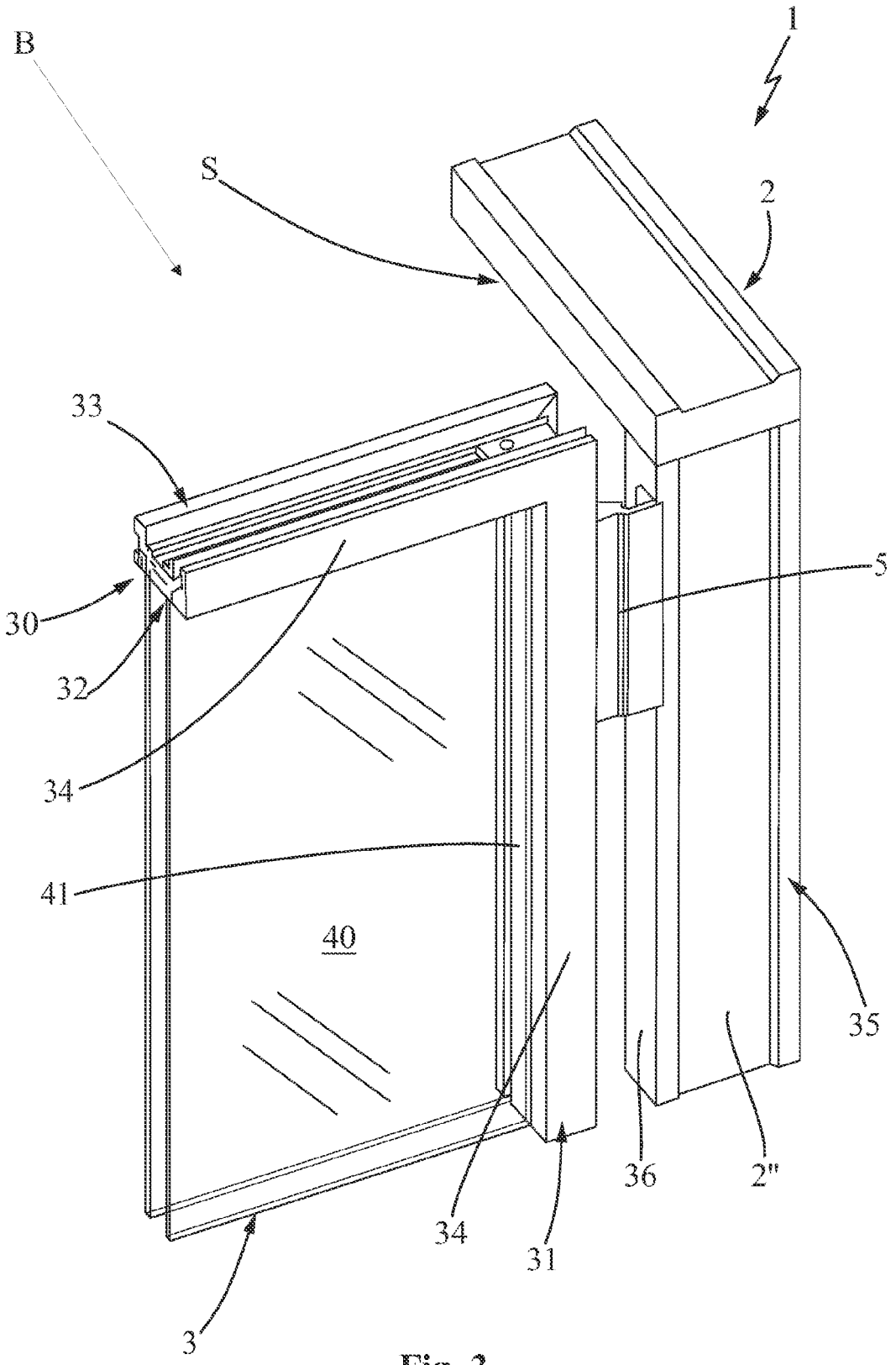
FIG. 3 is a perspective view of an angular portion of the outdoor window, according to the present invention, with the sash in an open position, viewed from outdoors.
Figure 4:
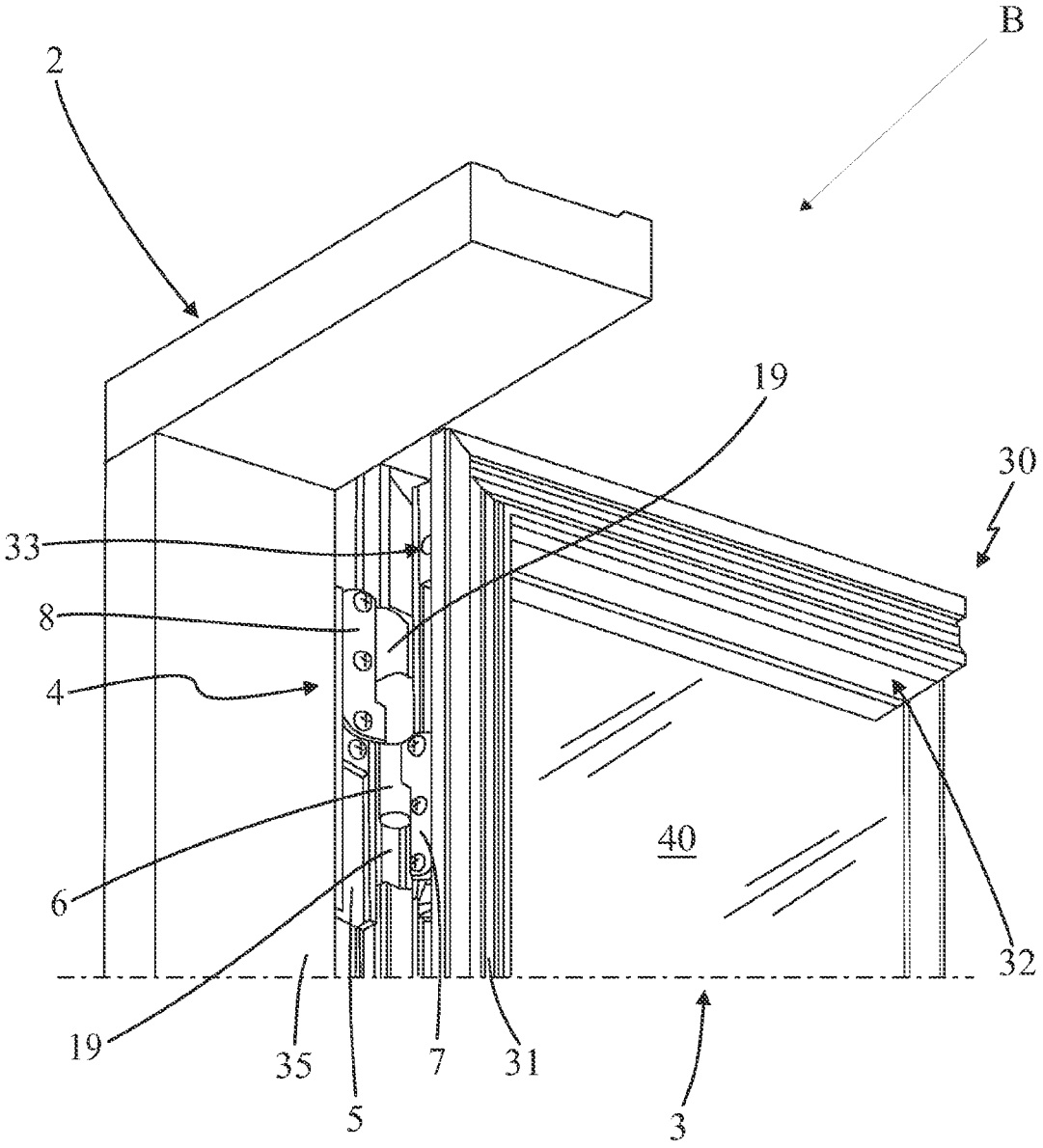
FIG. 4 is a perspective view of an angular portion of the outdoor window according to the present invention, with the sash in an open position, viewed from indoors.

With reference to the accompanying drawings, the outdoor window according to the present invention is designated as a whole by reference numeral 1.

It is formed in an inherently traditional manner by a movable sash 3 provided with a supporting frame 30, and with a fixed frame 2 intended to be used to open and to close an opening S arranged in the supporting structure of a building.

For example, the outdoor window may consist in a window, a door or a French window or other similar windows. The outdoor window 1 according to the present invention may be advantageously used to produce single windows or for the implementation of curtain glass walls given that it is associated with similar windows or also to fixed sash windows.

The supporting frame 30 of the movable sash 3 defines a movable lying plane P1 and perimetrically holds a glass panel 40 internally fixed, arranged parallel to said movable lying plane P1.

The glass panel 40 is advantageously double-glazed with at least two glass panels which are opposite and separated by an empty portion so as to provide good thermal insulation.

The fixed frame 2 is intended to be firmly fixed to the supporting structure of the building, for example through specially moulded brackets inserted in the wall (or in a frame of the building), for the production of both single windows and windows within curtain glass walls.

The supporting frame 30 of the movable sash 3 and the fixed frame 2 are respectively provided with a first upright 31 and with a second upright 35 which are joined to each other by a pivoting system 4 that rotatably supports the movable sash 3 on the fixed frame 2 between at least one closed position A, in which the movable sash 3 is parallel to the fixed frame 2 and the glass panel 40 is suitable to close the opening S, and at least one opening position B, in which the movable sash 3 is angled with respect to the fixed frame 2 and the glass panel 40 is suitable to free at least partially the opening S.

More specifically, the supporting frame 30 of the movable sash 3 is advantageously formed, in an inherently traditional manner, by two brackets, substantially vertical, and by two crosspieces, substantially horizontal, said brackets and crosspieces being rigidly fixed to each other at the respective ends so as to form four vertices of the supporting frame 30. The fixing at the vertices occurs in an inherently traditional manner for example using fastening means such as for example corner cleats, screws, tenons and pegs, not described in detail because known per se to a person skilled in the art.

The supporting frame 30 of the movable sash 3 preferably becomes substantially quadrangular or advantageously rectangular, and is adapted for supporting the glass panel 40 and for the mechanical resistance in order to connect the movable sash 3 to the fixed frame 2 using the pivoting system 4 described in detail below.

The supporting frame 30 preferably has a substantially quadrangular cross-section, such a term also including geometries that deviate from the perfectly square or rectangular shape due to the presence for example of the seat for the insertion and retainment of the glass panel 40 or to the presence of grooves for the fixing of gaskets or to the presence of sunk relief or embossing which mainly have an ornamental function.

The outdoor window 1, comprising its fixed frame 2 and movable sash 3 part, separates a building inner space from an external space and is provided with peripheral surfaces facing the centre of the opening S and of peripheral surfaces facing the wall or structure of the building to which it is mechanically connected.

With respect to such references below those indicated as outer lateral faces have been the ones of the perimeter edges of the fixed frame 2 and of the movable sash 3 facing the wall and as inner lateral faces those facing the opening S, that is the centre of the frame of the fixed frame 2 and of the movable sash 3. On the other hand those indicated as outer front faces have been the ones facing the outer space of the building and inner front faces those facing the inner space of the building, clearly considering the movable sash 3 to be closed.

Taking into account these spatial references, the supporting frame 30 of the movable sash 3 is provided with a first inner face 32, substantially facing the inner part of the supporting frame 30 and with a first outer lateral face 33, facing the outer part of the supporting frame 30.

Advantageously, the perimeter edge 41 of the glass panel 40 is engaged to the first inner lateral face 32 of the first bracket 31 of the movable sash 3.

The first outer later face 33 is substantially facing the opposite direction from the one faced by above-mentioned inner lateral face 32, that is towards the surface of the thickness of the building supporting structure (for example the thickness of the wall). In turn, the fixed frame 2 is formed in an absolutely traditional manner by two uprights and by two crosspieces, suitable to be fixed to each other at the respective ends so as to form four vertices of the frame, using per se traditional fastening means, such as for example corner cleats, screws, tenons and pegs, not described in detail because known per se to a person skilled in the art.

The uprights and the crosspieces of the fixed frame are advantageously made of wood and preferably have a substantially quadrangular cross-section, such a term also including geometries that deviate from the perfectly square or rectangular shape due to the presence for example to the presence of grooves for the fixing of moulded brackets for the fixing of the building supporting structure formed by its masonry or by a frame, for example made with steel beams.

Hence the fixed frame 2 becomes a rigid quadrangular and preferably rectangular continuous frame, and is intended for the static mechanical resistance which supports the movable sash 3 and is at the same time very slender (narrow) being substantially formed by flat wooden boards which define the above-mentioned closed quadrangular perimeter formation.

Taking into account the spatial references indicated above, the fixed frame 2 defines a second outer lateral face 2", which is intended to face the lateral wall that delimits the opening S arranged on the building supporting structure. Such second outer later face 2" is substantially perpendicular to the fixed lying plane PF of the fixed frame 2.

The movable lying plane P1 on which the supporting frame 30 of the movable sash 3 develops is parallel to the fixed lying plane PF of the fixed frame 2, when the sash is closed, while it is tilted with respect to it, when the movable sash 3 is open.

The first upright 31 of the movable sash 3 and the second upright 35 of the fixed frame 2, taken into consideration for the present invention, are those that carry mechanically coupled the pivoting system 4 mechanically coupled for the movement of the movable sash 3 with respect to the fixed frame 2. They are parallel to each other and normally develop vertically.

Advantageously, the inner lateral face 32 and the first outer lateral face 33 of the first upright 31 are preferably parallel to each other.

In turn, the fixed frame 2 defines a second front face 36 substantially parallel to the fixed lying plane PF of the fixed frame 2 and facing outwards from the supporting structure of the above-mentioned building.

The previously mentioned pivoting system 4 is arranged so as to mechanically connect the first upright 31 of the supporting frame 30 of the movable sash 3 and the second upright 35 of the fixed frame 2. They rotatably support the movable sash 3 on the fixed frame 2 between the closed position A, in which the movable lying plane P1 of the movable sash 3 is parallel to the fixed lying plane PF of the fixed frame 2, and the open position B, in which the movable lying plane P1 of the movable sash 3 is angled with respect to the fixed lying plane PF of the fixed frame 2.

Hence, with the movable sash 3 in a closed position A the glass panel 40 is placed to close the opening S arranged on the building supporting structure, being in a substantially parallel position to the fixed lying plane PF of the fixed frame 2, while with the movable sash 3 in an open position B the glass panel 40 is suitable to free at least partially the above-mentioned opening S, being in a substantially angular position to the fixed lying plane PF of the fixed frame 2.

According to the present invention the supporting frame 30 (and in particular the first upright 31) comprises a supporting section bar 300 connected with the pivoting system 4. Moreover, the supporting frame 30 comprises a protective section bar 14 mechanically connected to the supporting section bar 300 through fastening means 17. The protective section bar 14 defines a first front face 34 delimited between the first inner lateral face 32 and the first outer lateral face 33 of the first upright 31 of the supporting frame 30.

Also according to the invention the pivoting system 4 comprises at least one bracket 5 fixed to the fixed frame 2 and provided with a projecting portion 5A, that extends towards the outer space alongside the first outer lateral face 33 of the first upright 31 of the supporting frame 30 with the movable sash 3 in closed position A. Moreover, the pivoting system 4 comprises at least one hinge 6 having a rotation axis parallel to the first upright 31 and to the second upright 35 and preferably vertical.

The hinge 6 comprises a first wing 7 fixed to the supporting section bar 300 of the first upright 31 of the movable sash 3, and a second wing 8 fixed to the projecting portion 5A of the bracket 5.

The first front face 34 of the protective section bar 14 is substantially parallel to the movable lying place P1 of the movable sash 3 and its projection (on such movable lying place P1) towards the second upright 35 of the fixed frame 2 defines a volume V (shown in the accompanying cross-section Figures with an area formed by dotted lines), containing the hinge 6 when the movable sash 3 is in closed position A.

Figure 6:
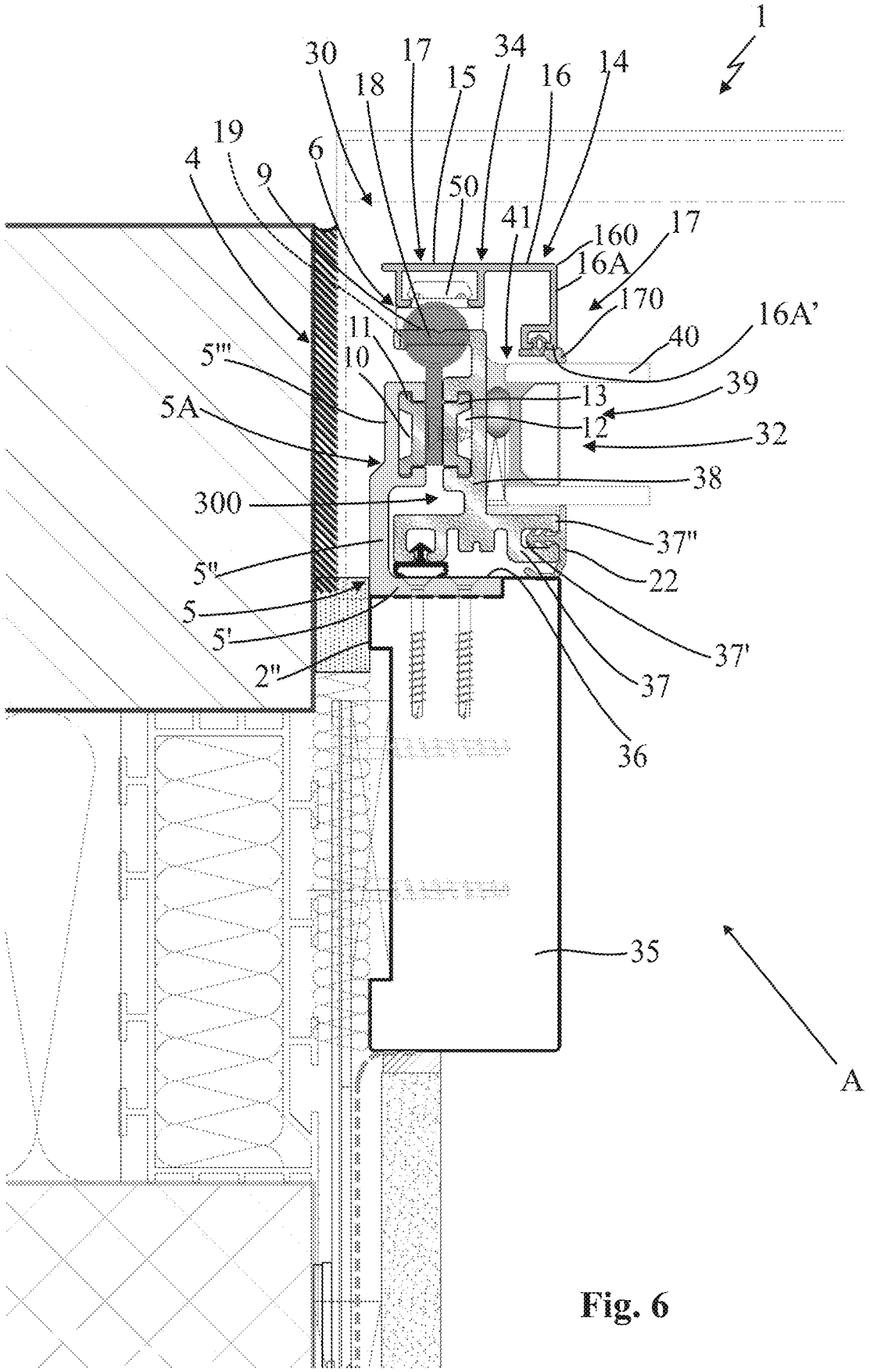
FIG. 6 is a detailed cross-sectional view of the outdoor window at an envisaged hinge with the sash in closed position.
Figure 7:
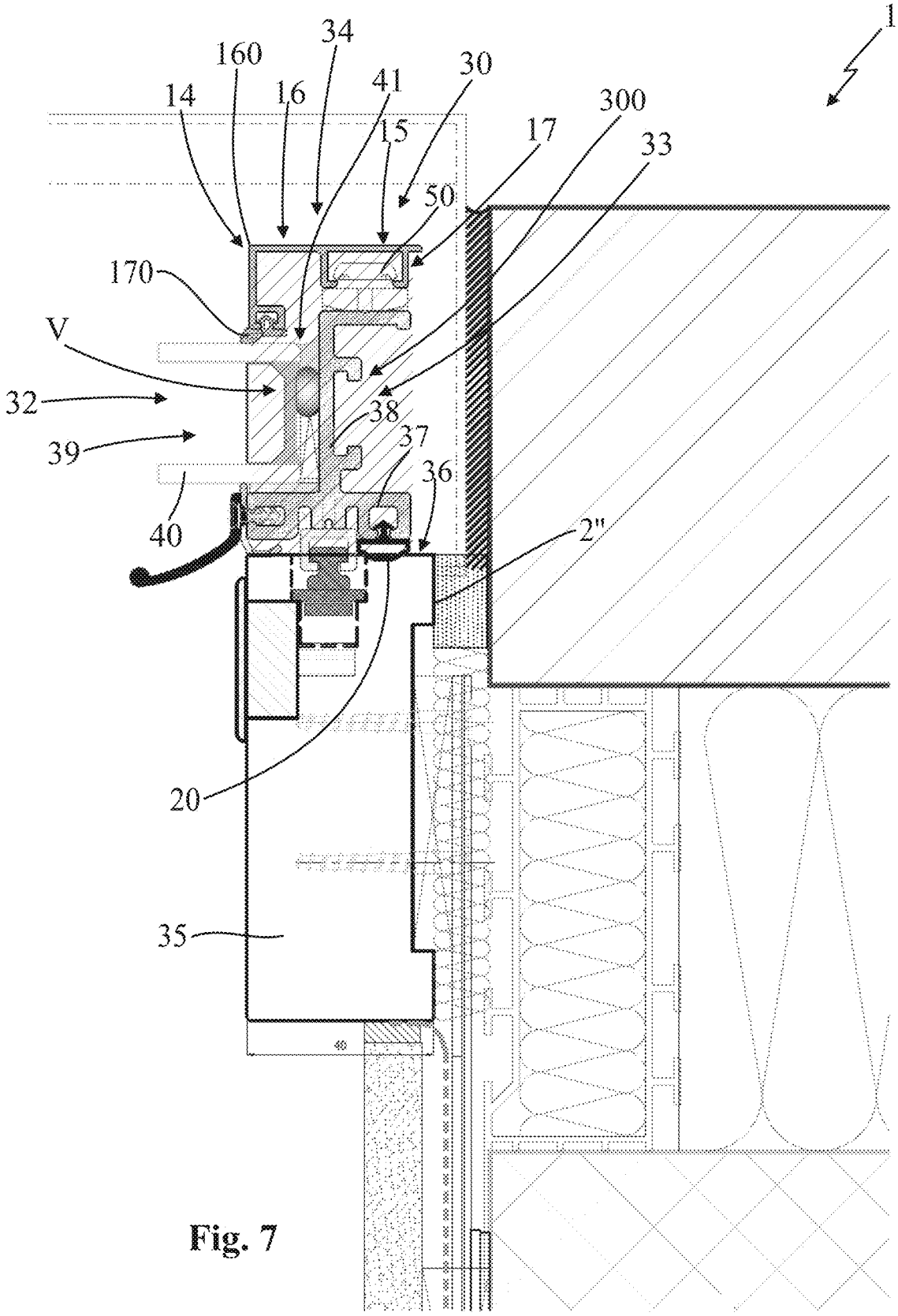
FIG. 7 is a detailed cross-sectional view of the outdoor window at the upright opposite the hinging upright.

The volume V is placed at the rear of the outer front face 34 (in an outdoors to indoors direction), containing therein the hinge 6, as shown in FIG. 6.

The hinge 6 further comprises at least one pivot 9, with an axis parallel to the uprights 31, 35 (and in particular vertical) placed to rotatable connect the first wing 7 and the second wing 8, for the rotation of the movable sash 3 with respect to the fixed frame 2. The projecting portion 5A of the bracket 5 extends projecting from the second front face 36 of the second upright 35 of the fixed frame 2 and carries the second wing 8 of the hinge 6 fixed so that the distance between said second front face 36 and the pivot 9 of the hinge 6 is greater or equal to the width of said first wing 7 (wherein such width is defined as the extension of the first wing 7 according to a direction which is orthogonal to the axis of the pivot 9 of the hinge 6).

Such a configuration enables, when the movable sash 3 is in closed position A, the first wing 7 to be positioned adjacent to the second wing 8 and to the projecting portion 5A of the bracket 5. In particular, when the movable sash 3 is in closed position A, the two wings 7, 8 of the hinge 6 are closed, in particular arranged parallel to each other defining an angle of substantially 0° between them.

Thanks to such a configuration, the hinge 6 remains hidden behind the first front face 34 of the protective section bar 14 not impairing the external aesthetics of the outdoor window 1. Moreover, this allows to significantly contain the volume of the first upright 31 of the movable sash 3 allowing to reduce the dimensions of the supporting frame 30.

Indeed, the arrangement of the projecting portion 5A of the above-mentioned bracket 5, enables to arrange the hinge 6 with the wings 7, 8 closed, when the movable sash 3 is in closed position A. Therefore, in such a position the first wing 7 of the hinge 6 is arranged substantially parallel to the first outer lateral face 33 of the first upright 31, allowing to reduce the thickness of the first upright 31 (considered to be the extension of the first upright 31 parallel to the movable lying plane P1 and orthogonal to the rotation axis of the hinge 6).

Moreover, thus, when the movable sash 3 is in the closed position A, the hinge 6 and the thickness of the first upright 31 occupy an extremely limited volume and are hidden by the first front face 34 of the protective section bar 14 that has a relatively small width.

For example, it is enough to set up the first front face 34 of the protective section bar 14 with a width even of only 38 mm in order to hide the volume of the hinge 6 and of the thickness of the first upright 31 when the movable sash 3 is in the closed position A (the width of the first front face 34 is defined as the extension of the latter parallel to the movable lying plane P1 and orthogonal to the rotation axis of the hinge 6).

Advantageously, the distance between the second front face 36 of the fixed frame 2 and the pivot 9 of the hinge 6 is greater or equal to the width of the supporting section bar 300 (wherein such a width is defined as the extension of the supporting section bar 300 orthogonal to the movable lying plane P1 of the movable sash 3). This advantageously enabled to obtain the above-mentioned volume reduction without needing to arrange niches inside the fixed frame 2, being therefore able to mount the movable sash 3 substantially on the second outer front face 36 of the second upright 35 of the fixed frame 2.

In accordance with the preferred embodiment of this invention, the supporting section bar 300 is made of a thermal insulation material, for example a plastic material.

Advantageously, it is chosen in a material in the group comprising PVC, polyamide resin with glass fibre.

In turn, the protective section bar 14 is preferably made of a metallic material, in particular aluminium, bronze or steel. In accordance with an embodiment illustrated in FIG. 10 such protective section bar may also be made from glass.

The glass panel 40 of the movable sash is perimetrically fixed to the supporting frame 30 and parallel to the movable lying plane P1. In accordance with the preferred embodiment the width of the protective section bar 14 is substantially advantageously equal to the width of the protective section bar 300.

Preferably, the protective section bar 14 is provided with an outer portion 15 that extends to cover the hinge 6 and with an inner portion 16 that extends to cover the the perimeter edge (41) of the glass panel (40).

Advantageously, the inner portion 16 of the protective section bar 14 defines a corner 160 between the first front face 34 and the inner lateral face 32 of the first upright 31 that extends up to the glass panel 40.

Preferably, the inner portion 16 of the protective section bar 14 is provided with an inner sector 16A that develops from the above-mentioned corner 160 towards the glass panel 40 up to its own free edge 16A' that rests on said glass panel 40. In particular, such resting of the free edge 16A' on the glass panel 40 occurs by means of the interposition of a sealant, such as a silicone or glue seam (as described in the examples mentioned below).

Preferably, the inner sector 16A of the inner portion 16 of the protective section bar 14 is substantially orthogonal to the movable lying plane P1 of the movable sash 3 and faces the inner part of the supporting frame 30 of the latter.

Advantageously, the first front face 34 of the protective section bar 14 is less than 15 mm away from the pivot 9 of the hinge 6, and preferably 10 mm and even more preferably at a distance of 8 mm.

The fastening means 17 connect the protective section bar 14 to the supporting section bar 300 directly or through the glass panel 40.

Figure 5:
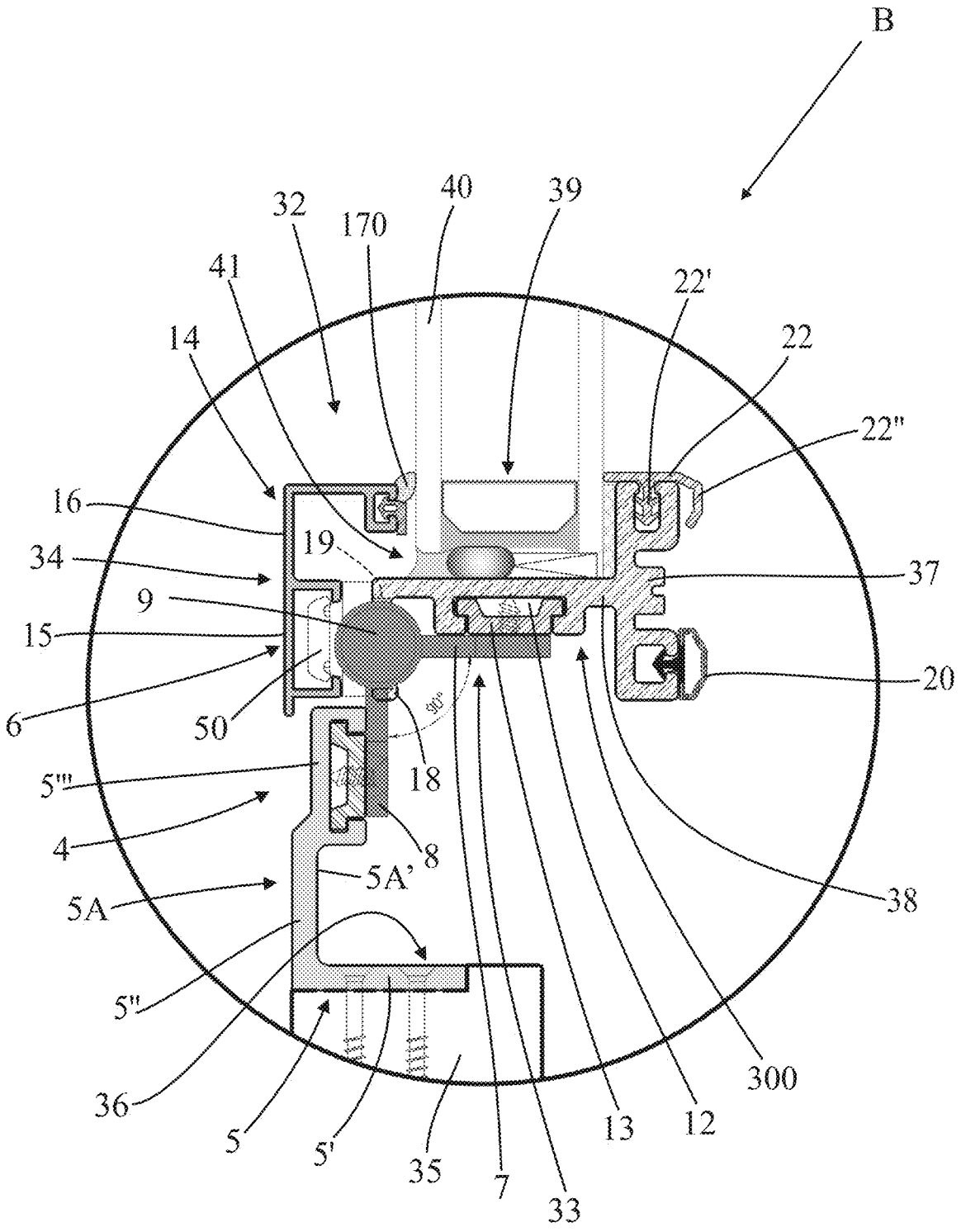
FIG. 5 is a detailed cross-sectional view of the outdoor window at an envisaged hinge with the sash in an open position.

In accordance with the embodiment illustrated for example in FIGS. 5 and 6, the supporting section bar 300 is provided with a ribbing 18 which extends opposite the protective section bar 14 and is provided with an opening 19 engaged by the hinge 6.

Also in accordance with the embodiment of FIGS. 5 and 6, the ribbing 18 develops facing the protective section bar 14 along the first upright 31 of the supporting frame 30 of the movable sash 3, and is provided with the above-mentioned opening 19 crossed by the hinge 6. Hence, the opening 19 interrupts the continuity of the ribbing 18 of the supporting section bar 300 only at the hinge 6 or rather at the provided hinge 6. Therefore, the opening 19 defines a seat to accommodate the hinge 6 and will preferably extend for a greater length than the length of the hinge 6 so as to enable a smooth pulling out of the movable sash 3 that has to be raised compared to the fixed frame 2 in order to pull out the second wing 8 from the pivot 9, and for the adjustment of the position of the movable sash 3 with respect to the fixed frame 2.

The fastening means 17 advantageously comprise a plurality of clips 50 provided with a shank fixed to the ribbing 18 and with an interlocking head engaging in seats arranged on the face of the protective section bar 14 which faces the inner part of the building.

Moreover advantageously the fastening means 17 provide for that the inner portion 16 of the protective section bar 14 is fixed to the glass panel 40 for example through a silicone seam 170, which collaborates in keeping the glass panel 40 anchored to the movable sash 3.

Figure 8:
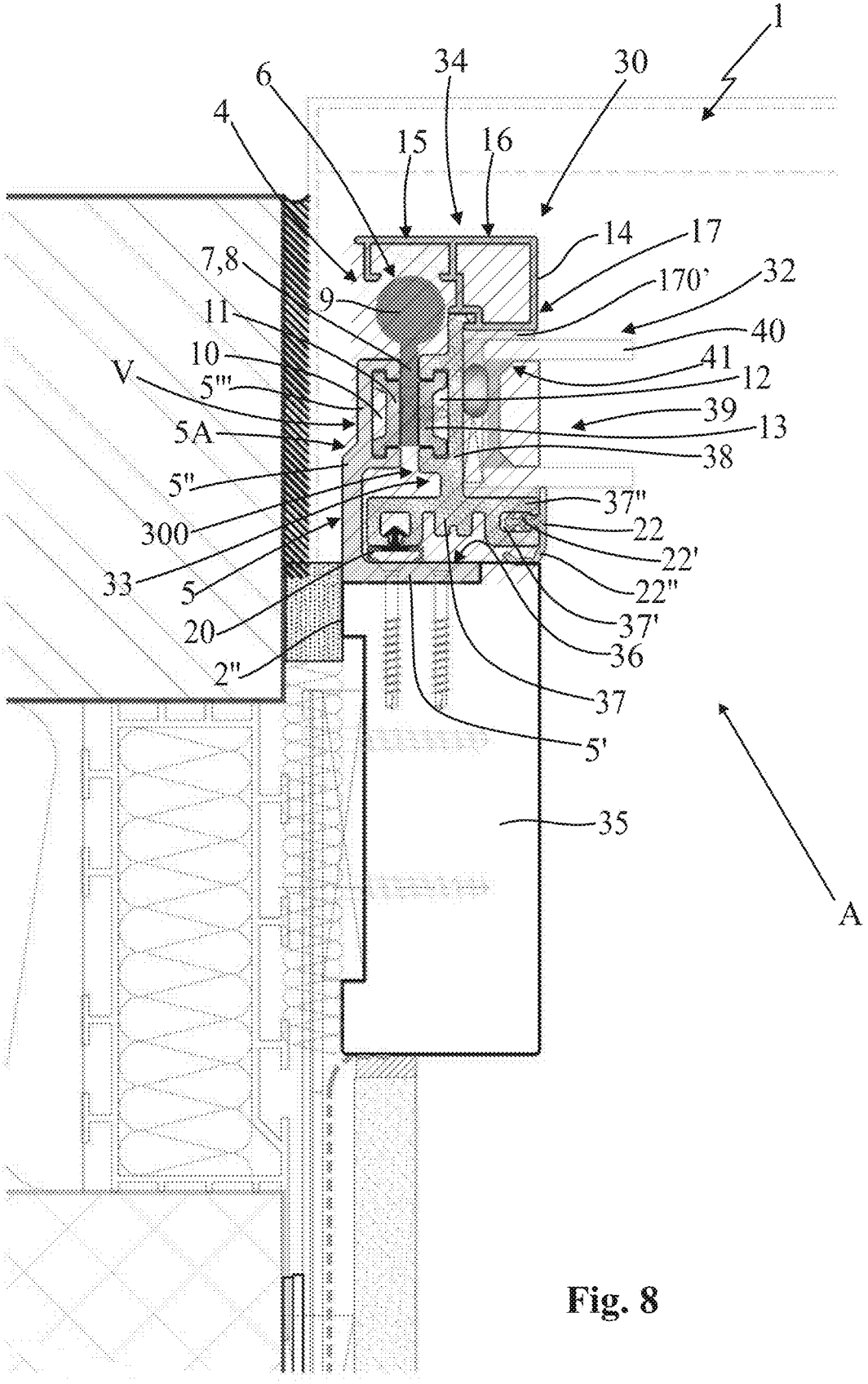
FIG. 8 is a detailed cross-sectional view of the outdoor window at a foreseen hinge with the sash in closed position, in which an envisaged protective section bar is directly fixed to the edge of the glass panel.
Figure 9:
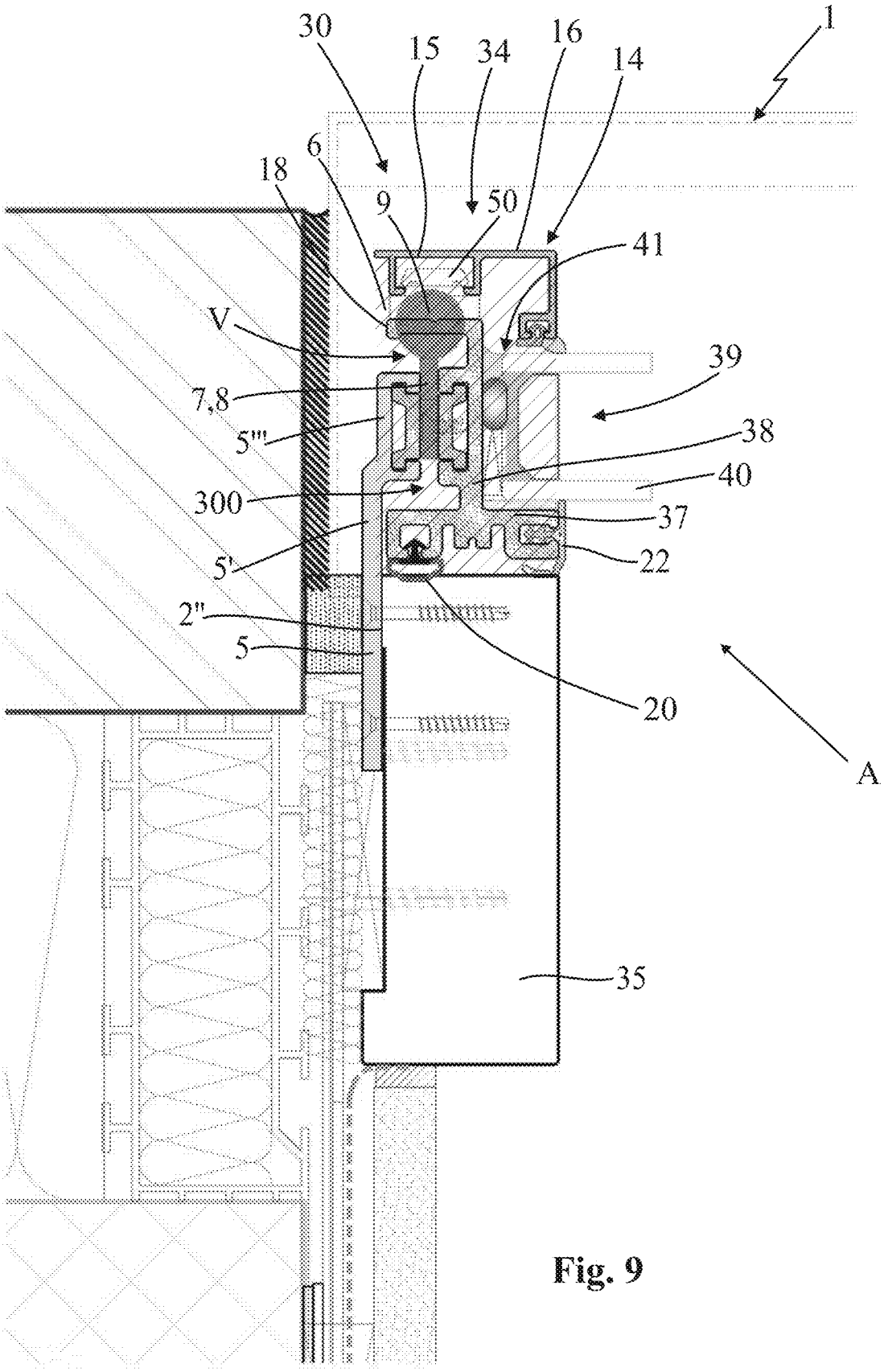
FIG. 9 is a different embodiment of a detailed cross-sectional view of the outdoor window at an envisaged hinge with the sash in closed position, in which an envisaged supporting bracket is no longer L-shaped as in the previous Figures but flattened.

On the contrary, in accordance with the embodiment illustrated in FIG. 8, the fastening means 17 connect the protective section bar 14 to the supporting section bar 300 through the glass panel 40. More specifically, the fastening means 17 comprise a glue seam 170', for example silicone, and the glass panel 40 mechanically engaged in a housing seat 39 arranged in the supporting section bar 300.

In accordance with the latter embodiment the supporting section bar 300 is hence not provided with the ribbing 18 and the protective section bar 14 is fixed to the front face of the movable sash 3 only through the fastening means 17 of the glue type, for example using the glue seam 170'.

In accordance with such embodiment the protective section bar 14 will no longer perform the function of mechanical retainment of the glass panel 40 and the latter will be entirely and sufficiently supported by the other three sides of the supporting frame 30 of the movable sash 3 for example by means of example gluing.

Figure 10:
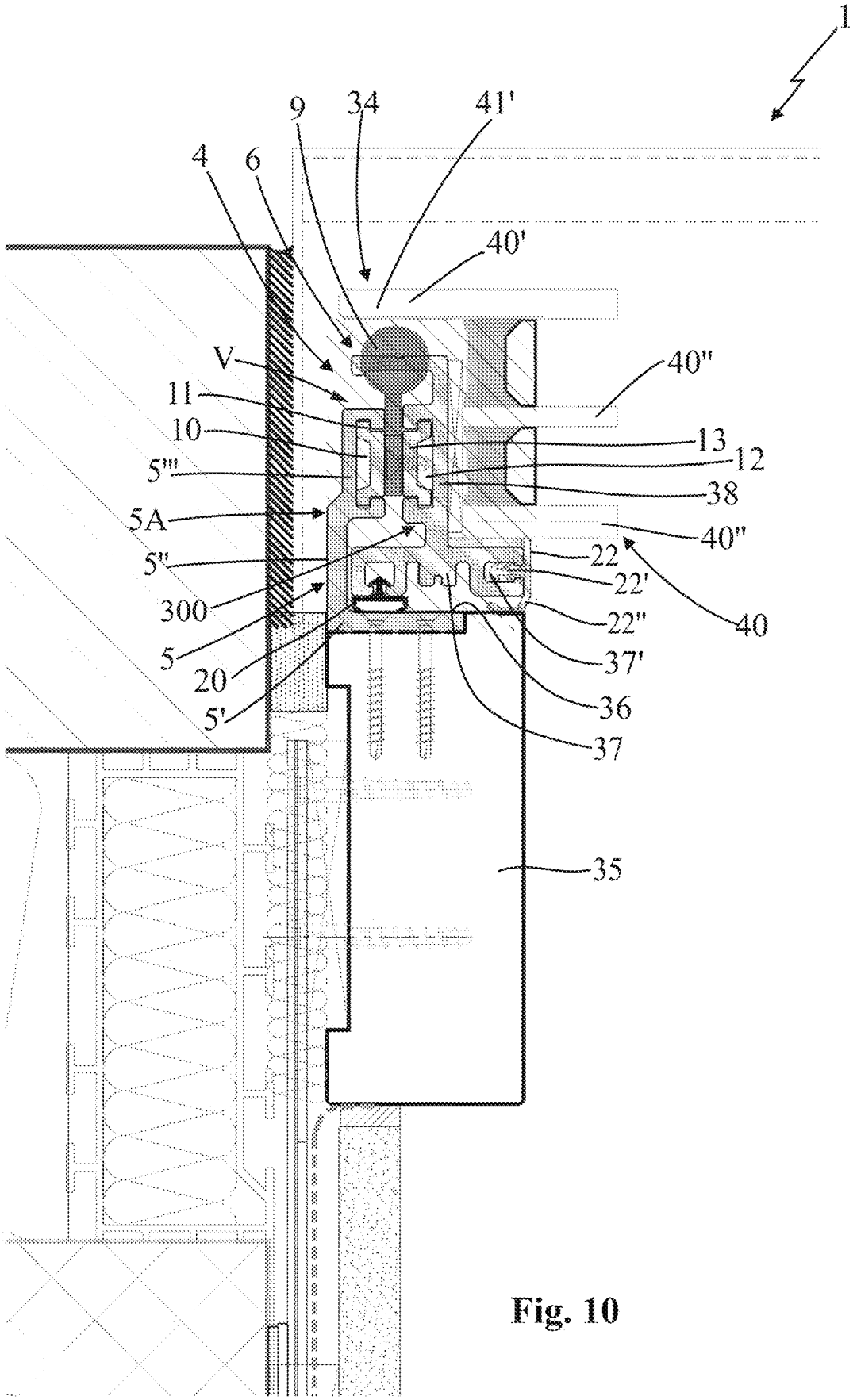
FIG. 10 is a different embodiment of a detailed cross-sectional view of the outdoor window at an envisaged hinge with the sash in closed position and with the edge of the glass panel extending to cover an envisaged hinge.

In accordance with a further embodiment shown in the accompanying FIG. 10, the glass panel 40 is provided with at least one outer sheet 40' and with at least one inner sheet 40" with the perimeter edge 41' of the outer sheet 40' extending peripherally outwards from the glass panel 40 more than the inner sheet 40" of the glass panel 40. The perimeter edge 41' of the outer sheet 40' of the glass panel 40 forms in this case the protective section bar 14 that hides with its projection the hinge 6 defining towards the fixed frame 2 the above-mentioned volume V containing the hinge 6 itself. In accordance with this latter embodiment the first front face 34 is composed of the outer face of the perimeter edge 41' of the outer sheet of the glass panel 40.

Advantageously the first front face 34 of the perimeter edge 41' of the outer sheet of the glass panel 40 (or the face opposite the edge 41' itself) may be knurled or provided with a similar manufacture so as to better hide the hinges 6 placed behind.

Advantageously, the supporting section bar 300 of the movable sash 3 is composed of a widened base 37, which is intended to face the fixed frame 2, when the movable sash 3 is in closed position A, and of a supporting wall 38, which develops from the widened base 37, and defines with the latter at the inner lateral face 32 of the first upright 31 of the supporting frame 30, a housing seat 39, adapted to receive the perimeter edge 41 of the glass panel 40. The supporting wall 38 extends outwards from the supporting structure of the building, in particular orthogonally to the widened base 37 starting from a central section of the latter. The widened base 37 of the supporting frame 30 is preferably parallel to the movable lying plane P1 of the movable sash 3.

More specifically, the second upright 35 of the fixed frame 2 is formed by a moulded profile, in particular wooden, with a substantially quadrangular cross-section, which defines at least partially the second front face 36, on which the widened base 37 of the supporting section bar 300 is intended to rest through at least one sealing gasket 20, when the movable sash 3 is in closed position A.

The outdoor window 1 according to the invention, preferably also comprises a covering profile 22, which overlays the inner lateral surface 37" (meaning facing the centre of the frame 30) of the widened base 37 and extends with a gasket end portion 22" beyond the widened base 37 in the opposite direction to the glass panel 40 to come into contact with the second front face 36 of the fixed frame 2.

The covering profile 22 has a fastening foot 22' engaged in a groove 37' arranged on the same lateral surface of the widened base 37.

Such covering profile 22 therefore forms a second gasket for the sealing of the movable sash 3 on the fixed frame 2.

Such covering profile 22 has for example a height of approximately 15 millimetres and forms a bridge that connects the glass panel 40 to the second upright 35 (for example wooden) of the fixed frame 2.

Such covering profile 22 is easily produced in epdm, in a thermoplastic material or in rubber and may thereby be made in the many different colours, as desired. On the contrary, the fibre with which the supporting section bar 300 is preferably made from would be more difficult to colour and it is an advantage that it is hidden by the covering profile 22 so as to be visible only in the thickness of the movable sash 3 open in a position where it appears as technical feature which does not aesthetically impair the movable sash 3.

Advantageously the supporting wall 38 and the widened base 37 of the supporting section bar 300 define the above-mentioned housing seat 39 to accommodate the perimeter edge 41 of the glass panel 40.

As above-mentioned, the supporting section bar 300 is advantageously made of a thermal insulation material, preferably glass fibre, to guarantee a high thermal insulation of the outdoor window.

The supporting section bar 300 of the movable sash 3 is preferably obtained in glass fibre through a pultrusion process that envisages the presence of a creel from which a fibre is extruded, in this case glass fibre, which undergoes an impregnating bath in which the fibres are tied to the mould by a resin. The thus impregnated fibres are caused to pass through a comb which has a guiding function in a preforming station in which the fibres are pressed and compacted. The fibres subsequently pass through a heated mould, so as to facilitate the resin polymerisation, having the shape of the cross-section of the desired final product, in this case the supporting section bar 300. The products made with this technology have excellent mechanical resistance properties in particular to the traction produced by an orientation of the fibres which is linear in the direction of the length of the product.

Advantageously, with reference to the embodiment of FIGS. 5 and 6, the above-mentioned ribbing 18 of the supporting section bar 300, projects starting from an end portion of the supporting wall 38 substantially parallel to the first front face 34 of the protective section bar 14. Preferably, such ribbing 18 does not extend sideways beyond the width of the protective station bar 14 so as to be also contained in the above-mentioned volume V.

Advantageously, the bracket 5, previously mentioned is more specifically provided with a base portion 5', fixed to the second front face 36 of the second upright 35 of the fixed frame 2 from which develops, advantageously substantially orthogonally, the projecting portion 5A for the fixing of the hinge 6 to the fixed frame 2.

Therefore, such bracket 5 is L-shaped with the projecting portion 5A that defines a light, for example of 1 cm with the wall (that is with an overlaying of the wall).

The projecting portion 5A of the bracket 5 preferably has a substantially plate shape with an inner face 5A' facing the first outer lateral face 33 of the first upright 31 of the supporting frame 30 when the movable sash 3 is in closed position A. In particular, the above-mentioned first face 5A' of the projecting portion 5A extends, parallel to the lying plane of the latter, along the width of the projecting portion 5A itself.

Advantageously, with reference to the embodiments illustrated in FIGS. 5, 6 8-10, the projecting portion 5A of the bracket 5 is in turn preferably composed of a shank portion 5" that develops from the base portion 5' and by a fastening portion 5'" that continues such shank portion 5" outwards from the building projecting by folding towards the inside of the opening S.

The first wing 7 of the hinge 6 is fixed by means of mechanical coupling means, such as for example screws, known per se to a person skilled in the art, to the supporting wall 38 of the supporting section bar 300. The latter is advantageously provided with a first seat 12, in which a first suitably moulded plate 13 is suitable to be accommodated to be retained in the first seat 12 and fixed to the first wing 7 for example by means of screws. Similarly the second wing 8 of the hinge 6 is for example fixed through mechanical coupling means, such as for example screws, known per se to a person skilled in the art, to the projecting portion 5A of the bracket 5 and more specifically to its one fastening portion 5'". Advantageously, the latter is provided with a second seat 10, in which a second plate 11 is suitable to be accommodated, suitably moulded to be retained in the second seat 10 and fixed to the second wing 8 for example by means of screws.

In accordance with different embodiments not all shown in the accompanying Figures, the wings 7, 8 of the hinge 6 and the plates intended to be fixed to the bracket 5 and to the supporting section bar 300 of the movable sash 3 may be produced as a single piece.

Figure 12:
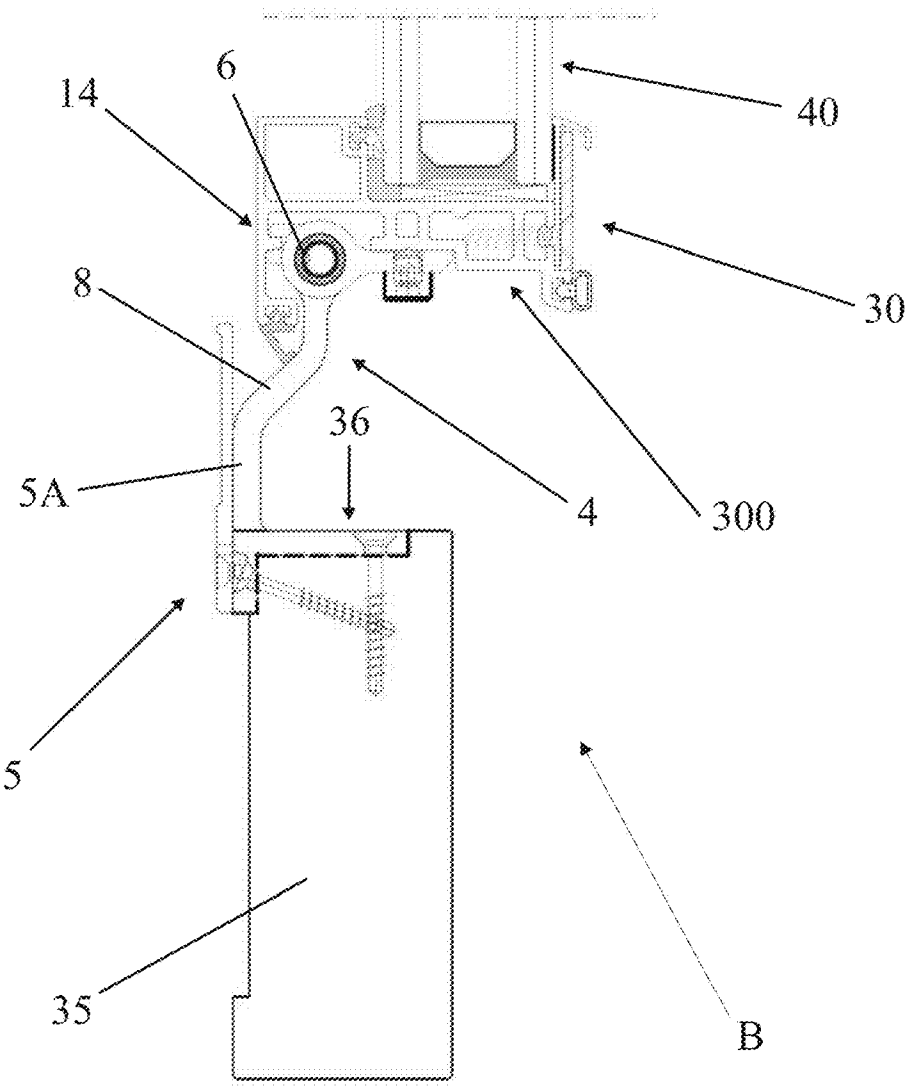
FIGS. 11 and 12 are a further different embodiment of the concerned outdoor window, with the sash in closed and open position respectively.
Figure 11:
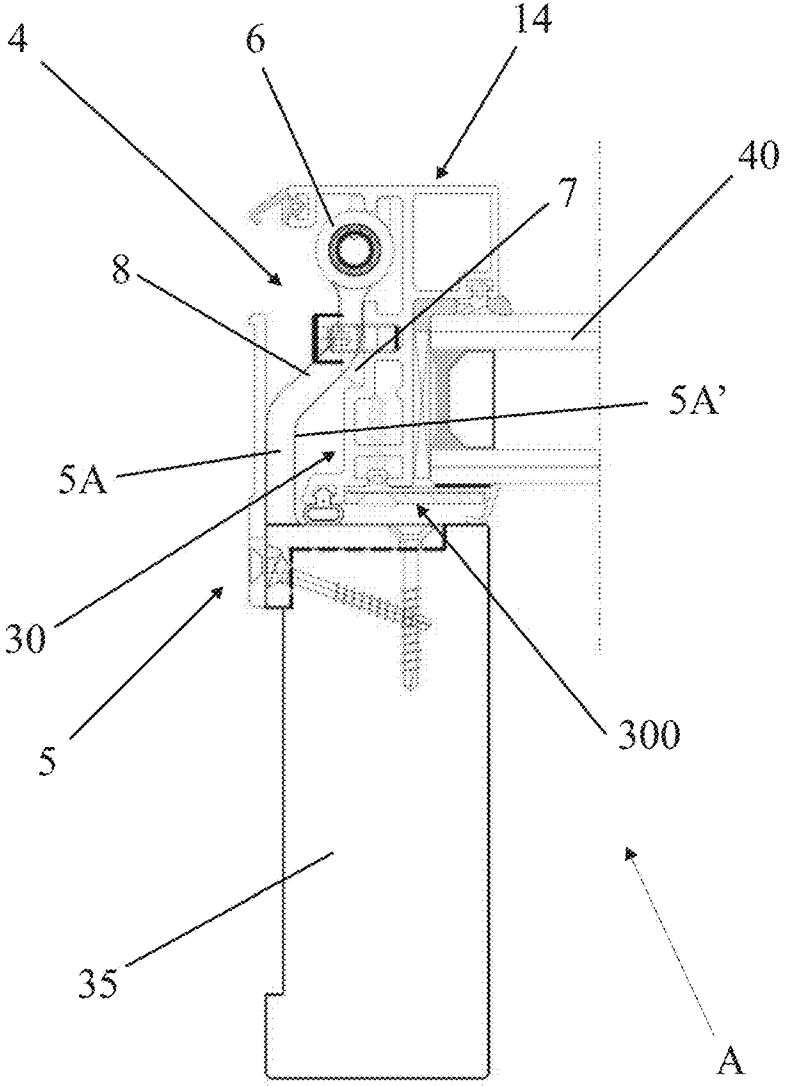
Figure 13:
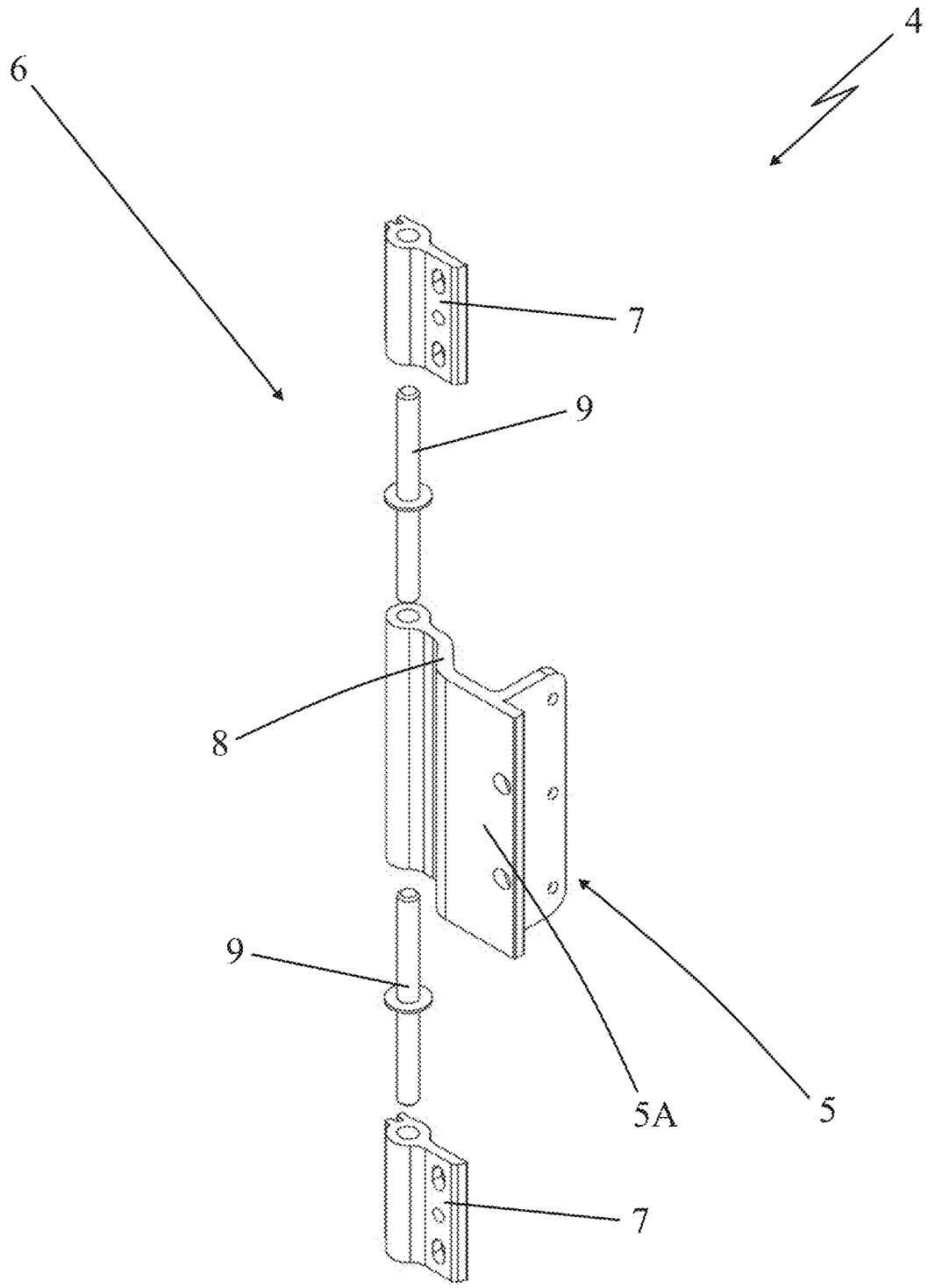
FIG. 13 is a detail of the outdoor window of FIGS. 11 and 12, relative to the hinge of the outdoor window itself.

For example, with reference to the embodiment shown in the FIGS. 11-13, the projecting portion 5A of the bracket 5 and the second wing 8 of the hinge 9 are produced as a single piece.

The protective section bar 14 and the supporting section bar 300 can suitably be produced as a single piece and be thus two portions of a single section bar like in the example of FIGS. 11 and 12, or may be produced with two distinct section bars like in the examples of FIGS. 5-9.

Advantageously, the second front face 36 of the second upright 35 of the fixed frame 2, which faces the outer space, is parallel to the fixed lying plane PF of the fixed frame 2 itself and projects (on the fixed lying plane PF) towards the hinge 6 that contains, when the movable sash 3 is in closed position A, the first front face 34 of the protective section bar 14.

Such a second front face 36 substantially defines the thickness of the second upright 35 of the fixed frame 2.

Advantageously, when the movable sash 3 is closed position A, the projection of the second front face 36 towards the hinge 6 contains the first front face 34 of the first upright 31 of the supporting frame 30 as well as preferably also the projecting portion 5A of the bracket 5.

The first front face 34 of the first upright 31 of the supporting frame 30 of the movable sash 3 has a width for example that is in the range 30-40 mm. In turn, the second front face 36 of the second upright 35 of the fixed frame 2 preferably has a width that is in the range 35-45 mm.

The first front face 34 preferably has a length which is shorter or equal to that of the second front face 36, and, as above-mentioned, is included inside the outward projection from the building of the second front face 36, when the movable sash 3 is in closed position A in order to ensure a reduced volume of the supporting frame 30.

In such closed position A of the movable sash 3 the two outer front faces 34, 36 of the movable sash 3 and of the fixed frame 2 are parallel to each other.

In accordance with a different embodiment (FIG. 9), the bracket 5 is not L-shaped but is substantially rectilinear with its flat base portion 5' extending seamlessly up to the fastening portion 5" and which is fixed by means of traditional mechanical coupling means, for example screws, to the second outer face 2" of the fixed frame 2 towards the masonry wall.

A bracket 5 is preferably envisaged for each hinge 6; on the contrary, the presence of a single bracket 5 that extends along all the entire height of the second upright 35 of the fixed frame 2 of the outdoor window 1 can be envisaged, on which the plurality of hinge 6 are suitable to be connected.

The window 1 thus conceived achieves all of the relative objectives.

The invention claimed is:

1. An outdoor window, comprising:

a movable sash provided with a supporting frame, wherein said supporting frame extends onto a first lying plane (P1) and comprises a first upright, which is provided with a first inner lateral face substantially facing an inner part of said supporting frame, and is provided with a first outer lateral face facing an outside of said supporting frame;

a fixed frame, which extends onto a second lying plane (PF), comprises a second upright and is intended to be fixed on a supporting structure;

a pivoting system arranged so as to mechanically connect the first upright of said movable sash and the second upright of said fixed frame for rotatably supporting the movable sash on said fixed frame between a closed position (A) and an open position (B);

wherein said supporting frame comprises:

a supporting section bar connected with said pivoting system; and a protective section bar mechanically connected to said supporting section bar and defining a first front face delimited between the first inner lateral face and the first outer lateral face of the first upright of said supporting frame;

wherein said pivoting system comprises:

a bracket fixed to said fixed frame and provided with a projecting portion, which is placed alongside the first outer lateral face of the first upright of the supporting frame with said movable sash in said closed position (A);

a hinge;

wherein said hinge comprises:

a first wing fixed to the supporting section bar of said movable sash;

a second wing fixed to the projecting portion of said bracket;

a pivot, which has an axis parallel to said first upright and to said second upright, and is placed to rotatably connect said first wing and said second wing to enable the rotation of said movable sash with respect to said fixed frame;

wherein the first front face of said protective section bar is substantially parallel to the first lying plane (P1) of said movable sash;

wherein a first projection of said first front face towards the second upright of said fixed frame defines a volume (V), which contains said hinge with said movable sash in said closed position (A);

wherein the second upright of said fixed frame is provided with a second front face substantially parallel to said second lying plane (PF) and intended to be facing outwards of said supporting structure;

wherein the projecting portion of said bracket extends projecting from the second front face of the second upright of said fixed frame and the second wing of said hinge is fixed to said projecting portion, so that a distance between said second front face and the pivot of said hinge is greater or equal to a width of said first wing, and so that, with said movable sash in said closed position (A), said first wing is positioned adjacent to said second wing and to the projecting portion of said bracket.

2. The outdoor window of claim 1, wherein the distance between the second front face of said fixed frame and the pivot of said hinge is greater or equal to an extension width of said supporting section bar, wherein the extension width of the supporting section bar is defined orthogonally to said first lying plane (P1).

3. The outdoor window of claim 1, wherein said bracket is provided with a base portion fixed to the second front face of the second upright of said fixed frame, wherein said projecting portion is extended from said base portion.

4. The outdoor window of claim 1, wherein said supporting section bar is made of a material chosen from the group comprising PVC and polyamide resin with glass fibre, and said protective section bar is made of a metallic material.

5. The outdoor window of claim 1, wherein said movable sash comprises a glass panel provided with a perimeter edge fixed to said supporting frame in parallel to said first lying plane (P1);

wherein said protective section bar has a bar width substantially equal to the extension width of said supporting section bar, is provided with an outer portion, which extends to cover said hinge, and with an inner portion, which extends to cover the perimeter edge of said glass panel.

6. The outdoor window of claim 5, wherein the inner portion of said protective section bar is provided with an inner sector that is extended towards said glass panel up to a free edge that rests on said glass panel.

7. The outdoor window of claim 5, wherein said protective section bar is provided with a ribbing which extends facing said protective section bar and is provided with an opening engaged by said hinge, so that said protective section bar is mechanically connected to said supporting section bar through said ribbing.

8. The outdoor window of claim 5, wherein said protective section bar is mechanically connected to said supporting section bar through said glass panel; wherein said supporting section bar is provided with a housing seat in which said glass panel is mechanically engaged.

9. The outdoor window of claim 8, wherein the supporting section bar of said movable sash comprises:

a widened base which faces said fixed frame with said movable sash in said closed position (A), and a supporting wall, which develops from said widened base and defines, with said widened base, said housing seat where the perimeter edge of said glass panel is engaged.

10. The outdoor window of claim 9, wherein said widened base is provided with an inner lateral surface;

wherein said outdoor window comprises a covering profile which overlays the inner lateral surface of said widened base and has a gasket end portion extending beyond said widened base in an opposite direction to said glass panel to come in abutment against the second front face of said fixed frame.

11. The outdoor window of claim 1, wherein the second front face of the second upright of said fixed frame has a second projection towards said hinge that contains, with said movable sash in closed position (A), the first front face of said protective section bar.

12. The outdoor window of claim 1, wherein said supporting section bar is provided with a first seat on said first outer lateral face, wherein a first plate, which is integral with the first wing of said hinge, is mechanically engaged in said first seat; wherein the projecting portion of said bracket is provided with a second seat in which a second plate is mechanically engaged, which is integral with the second wing of said hinge.

13. The outdoor window of claim 1, wherein the first front face of said protective section bar is separated from the pivot of said hinge by a separation distance lower than 15 mm.

14. The outdoor window of claim 1, wherein a first width of the first front face of said protective section bar is in the range 30-40 mm, and a second width of the second front face of the second upright of said fixed frame is in the range 35-45 mm.

15. The outdoor window of claim 1, wherein said movable sash comprises a glass panel (40) perimetrically fixed to said supporting frame in parallel to said first lying plane (P1);

wherein said glass panel is provided with an outer sheet and with an inner sheet, and a perimeter edge of said outer sheet extends peripherally towards outside of said glass panel to a greater extent than said inner sheet;

wherein the perimeter of said outer sheet defines said protective section bar.

* * * * *